US010413073B2

(12) United States Patent
Zoell

(10) Patent No.: US 10,413,073 B2
(45) Date of Patent: Sep. 17, 2019

(54) SEATING AND SUPPORT FURNITURE

(71) Applicant: Kinema GmbH, Olpe (DE)

(72) Inventor: Stefan Zoell, München (DE)

(73) Assignee: KINEMA GMBH, Olpe (DE)

( * ) Notice: Subject to any disclaimer, the term of this patent is extended or adjusted under 35 U.S.C. 154(b) by 0 days.

(21) Appl. No.: 15/519,903

(22) PCT Filed: Oct. 19, 2015

(86) PCT No.: PCT/DE2015/000515
§ 371 (c)(1),
(2) Date: Apr. 18, 2017

(87) PCT Pub. No.: WO2016/062298
PCT Pub. Date: Apr. 28, 2016

(65) Prior Publication Data

US 2017/0245646 A1 Aug. 31, 2017

(30) Foreign Application Priority Data

Oct. 20, 2014 (DE) ..... 20 2014 008 312 U

(51) Int. Cl.
*B60N 2/30* (2006.01)
*A47C 7/56* (2006.01)
(Continued)

(52) U.S. Cl.
CPC ..... *A47C 7/563* (2013.01); *A47C 3/22* (2013.01); *A47C 7/004* (2013.01); *A47C 7/006* (2013.01);
(Continued)

(58) Field of Classification Search
CPC ..... B60N 2/30; B60N 2/3011; A47C 13/00; A47C 1/143; A47C 1/028; A47C 5/10; A47C 7/503
See application file for complete search history.

(56) References Cited

U.S. PATENT DOCUMENTS

2014/0239680 A1 8/2014 Short

FOREIGN PATENT DOCUMENTS

CN 103181689 A 7/2013
DE 102008011309 B3 4/2009
(Continued)

OTHER PUBLICATIONS

International Preliminary Report on Patentability dated Apr. 25, 2017 corresponding to Application No. PCT/DE2015/000515.
(Continued)

*Primary Examiner* — Shin H Kim
(74) *Attorney, Agent, or Firm* — Nath, Goldberg & Meyer; Joshua B. Goldberg; Scott H. Blackman

(57) ABSTRACT

A piece of seating and supporting furniture with or without an armrest, comprising an upright and a basic seat and supporting structure (seat and structure) arranged thereon such that it can be pivoted about at least one horizontal axis, wherein the seat and structure has a seat surface which, in a first end position of pivoting about the horizontal axis, is arranged substantially in a horizontal plane, wherein the seat surface, in a second pivoting end position, is arranged transversely to the horizontal plane, wherein the seat and structure has a supporting surface arranged on a side of the seat and structure spaced apart from the seat surface. In another embodiment, a first end of a spring is connected to the upright, a second end of the spring is connected to the seat and structure, and the spring assists pivoting of the seat and structure about the horizontal axis.

20 Claims, 7 Drawing Sheets

(51) Int. Cl.

| | |
|---|---|
| ***A47C 9/02*** | (2006.01) |
| ***A47C 3/22*** | (2006.01) |
| ***A47C 7/00*** | (2006.01) |
| ***A47C 7/54*** | (2006.01) |
| ***A47C 7/60*** | (2006.01) |
| ***A47C 13/00*** | (2006.01) |

(52) U.S. Cl.
CPC ..... *A47C 7/543* (2013.01); *A47C 7/566* (2013.01); *A47C 7/60* (2013.01); *A47C 9/02* (2013.01); *A47C 9/025* (2013.01); *A47C 13/00* (2013.01)

(56) References Cited

FOREIGN PATENT DOCUMENTS

| | | | |
|---|---|---|---|
| DE | 202008017742 | U1 | 2/2010 |
| EP | 1116626 | A2 | 7/2001 |
| JP | 50109059 | | 8/1975 |
| JP | H07236544 | A | 9/1995 |
| JP | 9276069 | A | 10/1997 |
| JP | 2000210339 | A | 8/2000 |
| WO | 2007141054 | A1 | 12/2007 |

OTHER PUBLICATIONS

Witten Opinion of the International Searching Authority dated Jan. 22, 2016 corresponding to International Application No. PCT/DE2015/000515.

SEATING AND SUPPORT FURNITURE

This is a National Phase Application filed under 35 U.S.C. 371 as a national stage of PCT/DE2015/000515, filed Oct. 19, 2015, an application claiming the benefit of German Application No. 202014008314.2, filed Oct. 20, 2014, the content of each of which is hereby incorporated by reference in its entirety.

The invention relates to seating and support furniture with or without armrests, having a seating and support corpus exhibiting a seat surface and a support surface, which is provided by pivoting the seating and support corpus.

DE 20 2008 017 742 U1 describes seating and support furniture comprising a stand and at least one seating and support corpus, wherein the at least one seating and support corpus is arranged on the stand such as to be pivotable about at least one horizontal axis. In this case, the stand comprises a plurality of sections which are connected to one another by means of articulated joints, so that the stand can be changed into both a horizontal and also a vertical orientation of the stand, as a result of which a position of the at least one seating and support corpus can be adjusted at the same time. The seating and support corpus comprises a seat surface and a support surface and, in a side view along the horizontal axis, has an approximately triangular shape. The seat surface of the seating and support corpus is arranged in a first end position of a pivoting movement about the horizontal axis in a substantially horizontal plane, wherein the seat surface is arranged in a second end position of the pivoting movement transversely to the horizontal plane. The support surface of the seating and support corpus is arranged on a side of the seating and support corpus adjacent to the seat surface. In this case, the seat surface and the support surface are at an angle of roughly 45°. In addition to the adjustment of the seating and support corpus described above, the seating and support corpus can be pivoted about the horizontal axis into a second end position, so that instead of the seat surface, the user is faced with the support surface, which he can use for seat-standing, for example. The seating and support corpus may therefore be variably adjusted to the body and needs of the user, so that said user can either sit on or lean against the seating and support corpus. Disadvantageously, the adjustment of the seating and support corpus involves a plurality of time-consuming working steps, in addition to which the various possible adjustments result in an almost unlimited number of possible positions and orientations of the seating and support corpus, so that in some cases it is very difficult for the user to find a suitable position.

DE 10 2008 011 309 B3 shows a rotatable and height-adjustable seating furniture comprising a stand and a seating and support corpus, wherein the seating and support corpus is connected to the stand by a base part. A first end of a spring is articulated to the base part, wherein the spring is coupled with a second end to a control arm arrangement, wherein the control arm arrangement is coupled to the seating and support corpus. The seating and support corpus is pivotably arranged about a horizontal axis of the control arm arrangement which is mounted in the base part. In this case, the seating and support corpus has a seat surface which is arranged in a first end position of a pivoting movement about the horizontal axis in a substantially horizontal plane. By means of a positive guide, a backrest is coupled to the seat surface, so that a movement of the seat surface displaces the backrest along the positive guide from a first end position into a second end position. Following a pivoting movement or displacement into the second end position, the seat surface is still located substantially in a horizontal plane, wherein the backrest in this case is pivoted by the positive guide about approximately 30 degrees in a clockwise direction, so that the user can adopt a reclined sitting position. When the seating and support corpus is pivoted, the spring is tensioned, so that the spring supports the pivoting movement of the seating and support corpus back into the first end position about the horizontal axis.

It is the object of the invention to specify a seating and support furniture with or without armrests, having a seat surface and a support surface, which allows reliable, user-friendly operation.

This object is solved according to the invention by a seating and support furniture with or without armrests, having the features of an independent claim.

According to one aspect of the invention, a seating and support furniture with or without armrests is created which has a stand and a seating and support corpus, wherein the seating and support corpus is arranged on the stand such that it is pivotable about at least one horizontal axis. In this case, the seating and support corpus has a seat surface which is arranged in a first end position of a pivoting movement about the horizontal axis in a substantially horizontal plane, wherein the seat surface in a second end position of the pivoting movement is arranged transversely to the horizontal plane. In this case, the seating and support corpus has a support surface which is arranged on a side of the seating and support corpus spaced apart from the seat surface. A first end of a spring is attached to the stand, wherein a second end of the spring is attached to the seating and support corpus, and wherein the spring supports a pivoting movement of the seating and support corpus about the horizontal axis.

Because the seat surface in a first end position of the pivoting movement about the horizontal axis is arranged substantially in a horizontal plane, a user can use this seat surface in the manner of a traditional office chair. Advantageously, following the pivoting movement of the seating and support corpus, the support surface is arranged in such a position that the support surface can be used by the user as an alternative to the seat surface for the purpose of sit-standing. Because the seat surface in the second end position is arranged transversely, preferably roughly perpendicularly to the horizontal plane, the seat surface is arranged substantially parallel to the stand in the floor direction and does not therefore obstruct the user which he leans against the support surface for sit-standing. Because the first end of the spring is arranged on the stand and the second end of the spring is arranged on the seating and support corpus, the pivoting movement is advantageously supported, so that a user has to use a small amount of force for the pivoting movement, wherein, on the other hand, the pivoting movement back into the first end position is also advantageously damped, so that components of the seating and support furniture are not subject to unnecessary load and acoustic noises are damped at the same time.

The spring preferably tensions the seating and support corpus in the direction of the second end position of the pivoting movement. A main focus of the seating and support corpus is configured in such a manner that the spring, by being pretensioned in the direction of the second end position of the pivoting movement, advantageously supports the opening action, so that a user has to exert less force for the pivoting movement. At the same time, uncontrolled pivoting of the seating and support corpus from its first end position into its second end position is damped.

The first end of the spring is advantageously pivotably attached to the stand, so that the spring is advantageously attached in a co-pivotable manner. The pivotable attachment of the spring to the stand means that the first end of the spring is advantageously mounted on the stable stand, so that compressive forces which arise during a pivoting movement of the seating and support corpus do not damage unstable components, but are absorbed by the robust stand. The pivotable attachment of the first guide to the stand enables the spring to support or cushion the pivoting movement of the seating and support corpus. In order to exert a torque on the seating and support corpus, at least one end of the spring is supported against a part arranged outside the seating and support corpus.

The second end of the spring is preferably attached to the seating and support corpus in a pivotable manner. Advantageously, the spring can thereby be arranged in a co-pivotable manner and the supporting force action of the spring is transferred during the pivoting movement directly onto the seating and support corpus, without additional components having to be used.

At least one articulation axis of the spring preferably runs parallel to the horizontal axis. It is thereby advantageously achieved that the torque generated by the spring can be optimally used, in order to support the pivoting movement of the seating and support corpus about the horizontal axis.

According to a preferred embodiment, the support surface and the seat surface are arranged at a fixed angle to one another on the seating and support corpus. It advantageously results from this that the seating and support corpus can be configured integrally and thereby exhibits a high degree of stability. This high degree of stability is advantageous, as not only the seat surface but also the support surface carries the weight of a user during sit-standing. Alternatively, it is possible for the seating and support corpus to be configured in two pieces. However, this would necessitate an additional component to connect the seat surface and the support surface rigidly and safely.

The first and second end positions advantageously delimit a pivoting range which corresponds to the angle between the support surface and the seat surface. As a general rule, the angle between the seat surface and a backrest in the case of seating and support furniture is roughly 90 degrees. In the present case, the backrest is located on the opposite side of the support surface, so that the seat surface also forms an angle of roughly 90 degrees with the support surface. The fact that the pivot range corresponds to this angle means that it is advantageously guaranteed that the seat surface is arranged parallel to the extent of the stand in the second end position and does not inhibit the user's range of movement if he wishes to rest against the support surface during sit-standing. In addition, it is thereby guaranteed that following the pivoting movement the seat and support surface is arranged in substantially the same horizontal plane as the seat surface before the pivoting movement, so that the user load is introduced to the stand with little torque.

The horizontal axis is preferably realized in a ball joint, wherein the ball joint allows a three-dimensional movement of the seating and support corpus. A three-dimensional movement of the seating and support corpus advantageously activates the user's lower back and gluteal muscles, as a result of which said muscles are strengthened and possible back injuries are averted.

Alternatively, the horizontal axis is received in a single pivot, wherein the single pivot allows the pivoting movement about the horizontal axis. The single pivot advantageously guarantees a very stable kind of pivoting movement about the horizontal axis, which guarantees the robustness and durability of the pivoting mechanism. A further alternative articulated connection can be provided by a four-pivot mechanism, for example.

According to a preferred embodiment of the seating and support furniture, the first end of the spring is attached close to the horizontal axis. This means that even a small deflection of the spring is sufficient to allow a large pivoting angle.

The first end of the spring is advantageously arranged outside a usually vertical axis of the stand. This advantageously enables the first end of the spring to be attached to the stand outside said stand and it need not be fitted in the stand, which means that the spring is easier to replace in the event of a malfunction.

The first end of the spring is preferably arranged outside the horizontal axis. It is thereby advantageously achieved that a torque generated by the spring, in respect of the horizontal axis, is assigned a lever arm with a length other than zero, so that the elastic force can support the pivoting movement about the horizontal axis.

The first end of the spring is preferably attached in a base plane below the horizontal axis. In this way, it is advantageously guaranteed that a torque can effectively act on the seating and support corpus in respect of the horizontal axis.

In a further embodiment of the invention, the second end of the spring is arranged proximate to the support surface.

The second end of the spring is preferably arranged in a moving-around plane above the horizontal axis and preferably parallel to the base plane. Because the first end of the spring is arranged below the horizontal axis in the base plane and the second end of the spring is arranged above the horizontal axis in a moving-around plane, it is possible for the spring to support the pivoting movement by the user from the first end position into the second end position and at the same time advantageously damp the pivoting movement from the second end position into the first end position, since the spring exerts an active torque in respect of the horizontal axis. In this case, the pivoting movement takes place in a pivoting direction which is prescribed by the elastic force.

One side of the seating and support corpus opposite the support surface advantageously forms a backrest. This advantageously enables the user to lean back on the seating and support furniture in a comfortable position in the first end position too.

The backrest advantageously has a concave shape, so that it can mold to the shape of a user's back in a comfortable manner.

The support surface and the backrest are preferably covered with different material. This advantageously enables the support surface which is used for sit-standing and the backrest which is used for leaning against to have two different materials specially adapted to the needs of lower body garments, such as trousers, and the backrest to upper body garments, such as shirts or pullovers. In addition, it is possible for the backrest to be configured with a massage function, for example. Advantageously, the support surface and the backrest may be covered with identical material.

The seat surface and the support surface are advantageously covered with different material. In this way, it is advantageously possible for the seat surface to be covered with a material, for example, which is preferably used in colder winter months, wherein the support surface is covered with a material which is particularly permeable to moisture, so that in hot summer months, for example, sweat is quickly carried away from the user. Alternatively, the support surface and the seat surface are covered with identical material.

According to a preferred embodiment, the seating and support corpus comprises a rigid load-bearing structure, wherein the load-bearing structure reinforces and stiffens the seat surface and the support surface. The rigid load-bearing structure advantageously guarantees a stable seating and support corpus. In traditional chairs, the main load is borne by the seat surface, whereas the backrest or else the support surface only have to accommodate a fraction of the user's weight and can therefore have a less rigid and reinforced design. The rigid load-bearing structure advantageously guarantees both a reinforcement of the seat surface and also a reinforcement of the backrest or the support surface, as it is provided that the user rests their weight on either the seat surface or on the support surface. To this end, both the seat surface and also the support surface are able to bear the full weight of the user.

The load-bearing structure preferably comprises angular struts. The angular struts are particularly advantageous, since a user's natural sitting position has a substantially angular profile, which means that the angular struts are able to effectively reproduce and support the structure of the body.

The supporting structure is advantageously configured in one piece. It is thereby advantageously guaranteed that the load-bearing structure can be produced quickly and cost-effectively, as additional assembly work can be dispensed with. Alternatively, the load-bearing structure may, however, also be configured in two pieces or multiple pieces.

The seat surface and the support surface preferably rotate synchronously about the same angle. Alternatively, the seat surface rotates about a smaller angle than the support surface, as a result of which a collision with the stand can be prevented.

According to a preferred embodiment, impact noises which arise during the pivoting movement between the first and second end position can be acoustically damped by a buffer arranged between movable components. It follows from this that both components of the seating and support furniture are protected, as damping allows the material to be protected, and that the chair gives the impression of premium quality, in that the pivoting movement takes place as quietly as possible, so that in an office situation other staff members are not disturbed, for example, if the user pivots the seating and support furniture from the first end position into the second end position and back.

The pivoting movement can be advantageously triggered by a mechanism which releases a lock. This mechanism may either be a knob, a lever or an electronic device, which releases the lock once the user has triggered a sensor or another well-defined actuator signal triggers the mechanism. The seating and support furniture is thereby prevented from accidentally pivoting from the one end position into the second end position. At the same time, however, it is also made possible for the seating and support corpus to pivot automatically at a well-defined point in time. Alternatively, the mechanism can also be manually activated until a desired position is reached. This desired position may either be one of the end positions or an intermediate position.

The support surface is preferably arranged in a second end position in a horizontal plane. This makes it possible for the support surface to be suitable for comfortable sit-standing by a user.

According to a preferred embodiment, the support surface has a slightly convex shape. This slightly convex shape makes it possible for the support surface to be suitable for sit-standing in the second end position and for the support surface to adapt to the structure of a user's body in the bottom area. Alternatively, the support surface may also form a substantially flat plane.

The spring is preferably lockable by a locking means. The spring supports the pivoting movement from the first end position into the second end position and damps the pivoting movement from the second end position back into the first end position. Through a locking means which locks the spring, it is advantageously guaranteed that the support or damping only occurs when a user wishes and not accidentally. Both in the first end position and also in the second end position, a locking and fixing of the respective position can thereby be guaranteed. Alternatively, the spring can be locked in any intermediate position.

The locking means can advantageously be released by an actuator head. This actuator head is preferably arranged in such a manner that, on the one hand, it is not accidentally triggered by the user but, on the other hand, it can also be easily reached if the user would like to pivot the seating and support furniture. For this purpose, a side of the seating and support corpus facing away from the seat surface may be provided to receive the actuating button, for example.

According to a further embodiment, the spring is received in the seating and support corpus. This has the advantage that the spring is protected from external damage by the seating and support corpus and that, for example, a user's fingers are prevented from getting between the moving parts of the joints at which the spring is articulated, and thereby being injured.

According to a preferred embodiment of the seating and support furniture, the spring is configured as a gas spring. The gas spring may advantageously provide the pivoting movement through a small spring path; in addition, the gas spring exhibits a force virtually independent of the spring path. Alternatively, the spring may also be configured as a helical spring, angular spring, leg spring or another kind of spring.

A movable castor system is preferably attached to the stand, said castor system advantageously guaranteeing that the seating and support furniture in an office, for example, need not be carried but can easily be moved.

The stand is preferably height-adjustable by a spring system independent of the aforementioned spring. In this case, the spring system is pre-tensioned in the direction of a higher seat surface position. Even in the case of known office chairs, height adjustability is an important feature, in order to adapt the seating and support furniture to the needs of a user. In addition, in the present case even if the seat position is adapted to a user, the seating and support furniture can be readjusted in terms of its height following the pivoting movement into the second end position, in order to provide the user with a comfortable sit-standing position; this is advantageously facilitated by the height-adjustable spring system in the stand.

The spring system is advantageously received in the stand. This means that no unnecessary space is taken up by the spring system, wherein the spring system is at the same time covered by the stand, creating a visually more attractive appearance. Furthermore, the encasing of the spring system prevents a user's fingers from getting between the movable parts of the spring system, for example, and being injured as a result.

According to one aspect of the invention, a seating and support furniture, with or without armrests, is created which has a stand and a seating and support corpus, wherein the seating and support corpus is arranged on the stand such that it can be pivoted about at least one horizontal axis. The seating and support corpus has a seat surface which is arranged in a first end position in a pivoting movement about the horizontal axis of a substantially horizontal plane, wherein the seat surface is arranged in a second end position of the pivoting movement transverse to the horizontal plane. The seating and support corpus has a support surface which is arranged on a side of the seating and support corpus, wherein the stand has an extendable stopping mechanism and wherein the extendable stopping mechanism can be activated from a predefined height.

The extendable stopping mechanism advantageously allows the seating and support furniture to which a movable castor system is attached, for example, to be reliably fixed on a floor, so that accidental movement of the seating and support furniture is prevented. The extendable stopping mechanism is advantageously activatable from a given height, as the stopping mechanism should preferably be used only in the second end position for sit-standing, which height is higher than the first end position used for sitting. If the seating and support corpus of the seating and support furniture is in the first end position, the user sits on the seat surface, so that the movement of the seating and support furniture by the castor system, as with current office chairs, is even desirable. During sit-standing in the second end position, however, it is desirable for the movable castor system to be blocked. This is achieved by the stopping mechanism.

The stand is preferably height-adjustable by a spring system; this guarantees that the user can adopt his desired position. In this case, the spring system is pre-tensioned in the direction of a higher seat surface position, so that the weight of the seating and support corpus can advantageously be countered.

In a preferred development, the spring system exhibits the stopping mechanism, wherein the stopping mechanism can be controlled by the spring system. This advantageously guarantees that the height-adjustable spring system simultaneously controls the stopping mechanism, so that no additional mechanism is needed in order to fix a castor system.

The stopping mechanism can preferably be triggered by a vertical force on the seating and support corpus and thereby blocks a movable castor system attached to the stand. This vertical force may be generated by sit-standing, for example. The vertical force that is required in order to trigger the stopping mechanism is, however, advantageously substantially smaller than the weight of a typical user, which means, for example, that even a child can easily trigger the stopping mechanism. In particular, the vertical force to be applied is so small that the stopping mechanism can be triggered by applying moderate pressure with the hands and the movable castor system blocked. In this case, the stopping mechanism can be set in such a manner that it can only be triggered from a predefined height.

The stopping mechanism of the spring system is preferably lockable and can be triggered by a mechanism. This advantageously guarantees that the stopping mechanism cannot be accidentally triggered, so that the seating and support furniture can be moved by the castor system. A user is thereby prevented from leaning against the seating and support furniture, for example, and the seating and support furniture yielding under the force and travelling away, so that under certain circumstances the user would be injured.

An end region of the stopping mechanism facing away from the seat surface is preferably covered with a brakeable material such as hard rubber, plastic or another brakeable material.

According to one aspect of the invention, seating and support furniture, with or without armrests, is created which has a stand and a seating and support corpus, wherein the seating and support corpus is arranged on the stand in a manner pivotable about at least one horizontal axis. The seating and support corpus has a seat surface which is arranged in a first end position in a pivoting movement about the horizontal axis in a substantially horizontal plane, wherein the seat surface is arranged in a second end position of the pivoting movement transverse to the horizontal plane. The seating and support corpus has a support surface which is arranged on one side of the seating and support corpus spaced apart from the seat surface, wherein a cover part is movably attached to the seating and support corpus and wherein the cover part is movable in respect of the seating and support corpus, so that on one side of the seating and support corpus facing away from the support surface, an extended backrest is created by the extended cover part, the surface of said backrest being sectionally formed from the seating and support corpus and from the cover part.

This advantageously allows the support surface or the backrest to have a longer configuration when sitting in the first end position than when sit-standing in the second end position. In this way, the support surface has a smaller lever arm, so that a less severe load is applied to the seating and support corpus. In addition, the backrest may be built in such a manner that it conforms to DIN standard EN 1335-1:2002-08 or else satisfies a minimum height for a backrest of an office chair.

The cover part is preferably coupled via a kinematics system to the seating and support corpus, wherein the actuation of the kinematics may be coupled to the pivoting movement. In this way, it is possible for the cover part to be automatically moved from its extended position into its retracted position during the pivoting movement from the first end position into the second end position. The kinematics may, for example, be a four-pivot kinematics system. Further advantages, properties and developments of the invention result from the dependent claims and also from the following description of a preferred exemplary embodiment.

The invention is explained in greater detail below with reference to the attached drawings with the help of a preferred exemplary embodiment.

Figure 1:
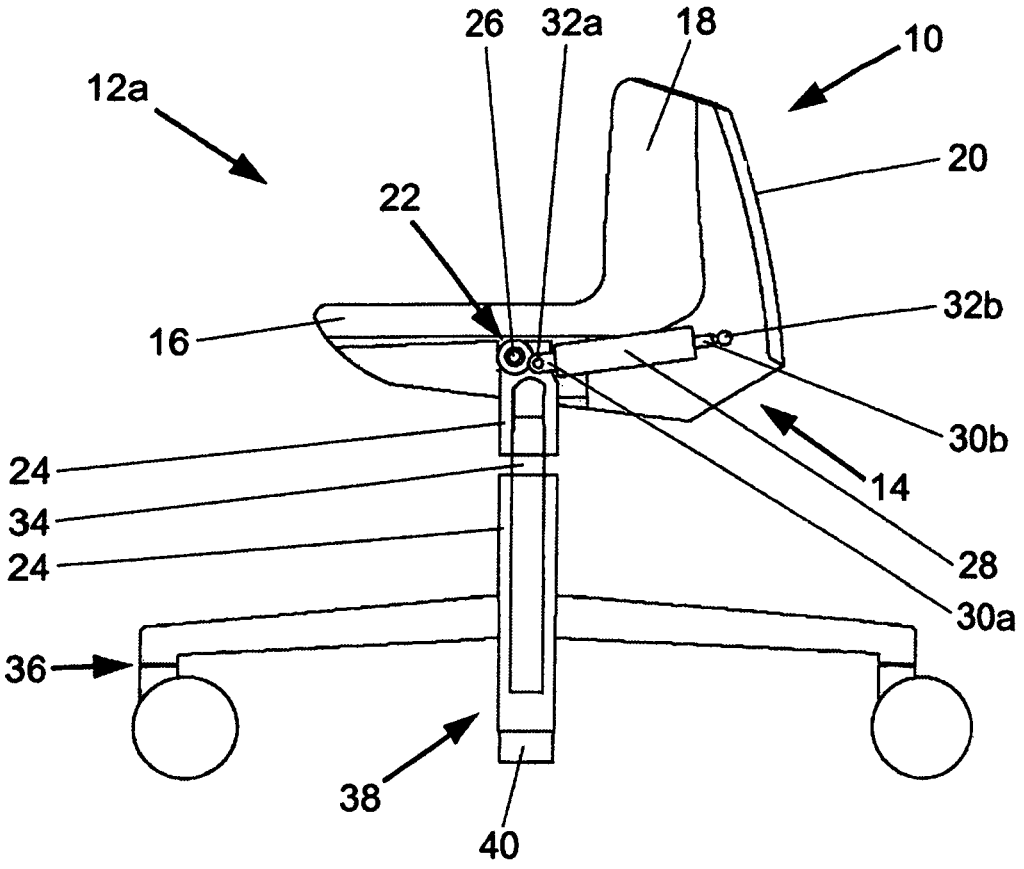
FIG. 1 shows a seating and support furniture in a first end position in side view.

FIG. 1 shows a seating and support furniture 10 in a first end position 12*a* in side view. The seating and support furniture 10 comprises a seating and support corpus 14 which is configured in the form of a square with legs standing substantially perpendicular to one another. Similarly, this is also the case with traditional office chairs. The seating and support corpus 14 comprises a seat surface 16 on which a user can rest his bottom region. On a surface side of the seating and support corpus 14, on which the seat surface 16 is arranged, a backrest 18 is additionally arranged, against which the user's back region can rest. In an upwardly curved region of the seating and support corpus 14, the seat surface 16 changes seamlessly into the backrest 18. In the present case, a plane of the seat surface 16 and a plane of the backrest 18 form an angle of approximately 90 degrees. The seat surface 16 runs substantially along a horizontal plane, whereas a support surface 20 runs substantially along a vertical plane.

On one side of the seating and support corpus 14 facing away from the backrest 18 is arranged the support surface 20. This support surface 20 may be used by a user for sit-standing during a corresponding pivoting movement of the seating and support furniture 10. In relation to a vertical line which runs between the backrest 18 and the support surface 20 along the seating and support corpus 14, the backrest 18 is configured in a concave shape and the support surface 20 in a convex shape.

The seating and support corpus 14 is mounted in a single pivot 22 in a stand 24. The single pivot 22 comprises a horizontal axis 26 about which the seating and support corpus can be pivoted about approximately 90 degrees—in an anti-clockwise direction in FIG. 1.

Figure 2:
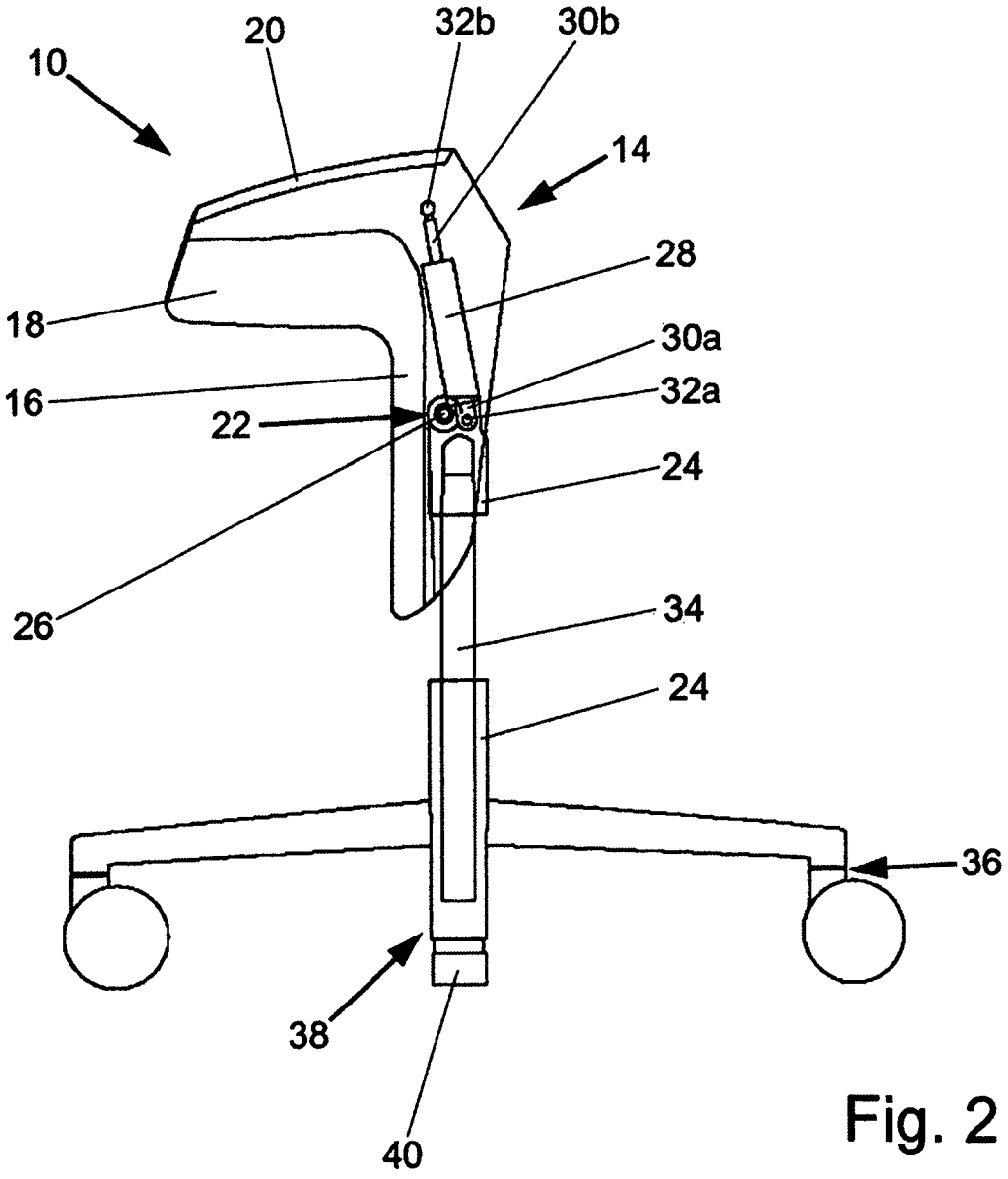
FIG. 2 shows the seating and support furniture from FIG. 1 in side view in a second end position with an extended stopping mechanism.

In order to support a pivoting movement of this kind about the horizontal axis 26, a spring 28 configured as a gas pressure spring is arranged on the seating and support furniture 10. In this case, the spring 28 is attached at a first end 30*a* via an articulation axis 32*a* to the stand 24 in an articulated manner and at a second end 30*b* in an articulated manner by means of a second articulation axis 32*b* to the seating and support corpus 14. The spring 28 in the present case is configured as a gas pressure spring which is shown in a pretensioned state in FIG. 1. The articulation axis 32*a* of the spring 28 is located in a horizontal base plane which is spaced further apart from the seat surface 18 than a horizontal plane which runs through the horizontal axis 26. The articulation axis 32*b* of the spring 28 is located in a horizontal moving-around plane which is spaced less far away from the horizontal plane of the horizontal axis 26 than the horizontal plane which runs through the horizontal axis 26. In the first end position, the moving-around plane has a smaller height than in the second end position, as it follows the pivoting movement. This height-offset arrangement of the articulation axes 32*a*, 32*b* from the horizontal axis 26 guarantees that the pretensioned spring 28 can exert a torque on the seating and support corpus 14 which supports the pivoting movement about the horizontal axis 26 in a clockwise direction. In this way, the spring 28 can easily pivot the seating and support corpus 14 into the second end position 12*b* which is shown in FIG. 2. In FIG. 2 the spring 28 is in a relaxed state. During a pivoting-back from the second position 12*b* into the first end position 12*a*, the spring 28 has a damping action, so that impact noises or forces are reduced or damped.

A locking mechanism is preferably provided which locks the seating and support furniture both in the first position 12*a* shown in FIG. 1 and also in the second end position 12*b* shown in FIG. 2, so that an accidental pivoting movement is prevented. To achieve this, the locking mechanism blocks the pivoting movement.

The stand 24 in the present case is configured as a height-adjustable stand 24. For this reason, the stand 24 has a two-part configuration. A spring system 34 is contained in the stand 24, wherein the spring system 34 is configured as a height-adjustable spring system 34 and controls the height adjustment of the sitting and support furniture 10. To achieve this, the spring system 34 is housed centrally in the stand 24 and enclosed thereby, so that a visually more attractive appearance results, but also, for example, the user's fingers are prevented from easily getting between movable parts of the spring system 34, thereby injuring the user. In the present case, the axis of the spring system 34 coincides with the vertical axis 24 of stand 24.

In a lower region of the stand 24 facing away from the seating and support corpus 14, a movable castor system 36 with five castors is attached to the stand 24, so that the seating and support furniture 10 can be moved quickly and easily on a base by the user sitting on the seat surface 16, in the manner of a traditional office chair.

The spring system 34 additionally comprises a stopping mechanism 38. At one end of the stand 24 facing away from the seating and support corpus 14 is arranged an end region 40 of the stopping mechanism 38 which is shown in FIG. 1 in the retracted state, so that there is no contact with a planar base and the seating and support furniture 10 can be moved by the movable castor system 36.

FIG. 2 shows the seating and support corpus 24 in its second end position 12*b*, so that a user can use the support surface 20 for sit-standing. The support surface 20 is arranged substantially parallel to a horizontal plane of the seat surface 16 from FIG. 1, wherein the seat surface 16 in FIG. 2 is arranged substantially parallel to a vertical plane of the support surface 20 from FIG. 1. It follows from this that the seating and support corpus 14 has moved through a pivot angle of substantially 90 degrees. Both in FIG. 1 and also in FIG. 2, so in both end positions 12*a*, 12*b* of the pivoting movement, the first articulation axis 32*a* of the spring 28 is arranged in a base plane which is spaced less far away from the castor system 36 than the horizontal axis 26. Both in FIG. 1 and also in FIG. 2, so in both end positions of the pivoting movement 12*a*, 12*b*, the second articulation axis 32*b* is spaced further apart from the castor system 36 than the horizontal axis 26. In the second end position 12*b*, a perpendicular line which starts from a surface of the backrest 18 points in a direction which runs parallel to an extent of the stand 24.

In the second end position 12*b*, the support surface 20, starting from an initial point arranged substantially vertically above the stand, up to an end point in the direction of the castor system 36, exhibits a slightly sloping curve which results in a comfortable sit-standing position.

In FIG. 2, the height-adjustable spring system 34 is in an extended state; in this case the single pivot 32 is spaced further apart from the castor system 36 than in FIG. 1. In addition, FIG. 2 shows that the end region 40 of the stopping mechanism 38 is in an extended state, so that the end region 40 of the stopping mechanism 38 is spaced at least exactly as far from the horizontal plane through the horizontal axis 26 as a side of the castor system 36 facing away from the horizontal plane. It therefore follows that the end region 40 of the stopping mechanism 38 is in contact with a floor or a base and thereby prevents movement of the castor system 36, so that the seating and support furniture has a fixed position when a user rests or perches on the support surface 20 for sit-standing. It is thereby ensured that the seating and support furniture 10 cannot accidently roll away and the risk of injury to the user is reduced. For this purpose, the end region 40 of the stopping mechanism 38 is preferably made of a material such as hard rubber, plastic or a similar brakeable material.

Figure 3:
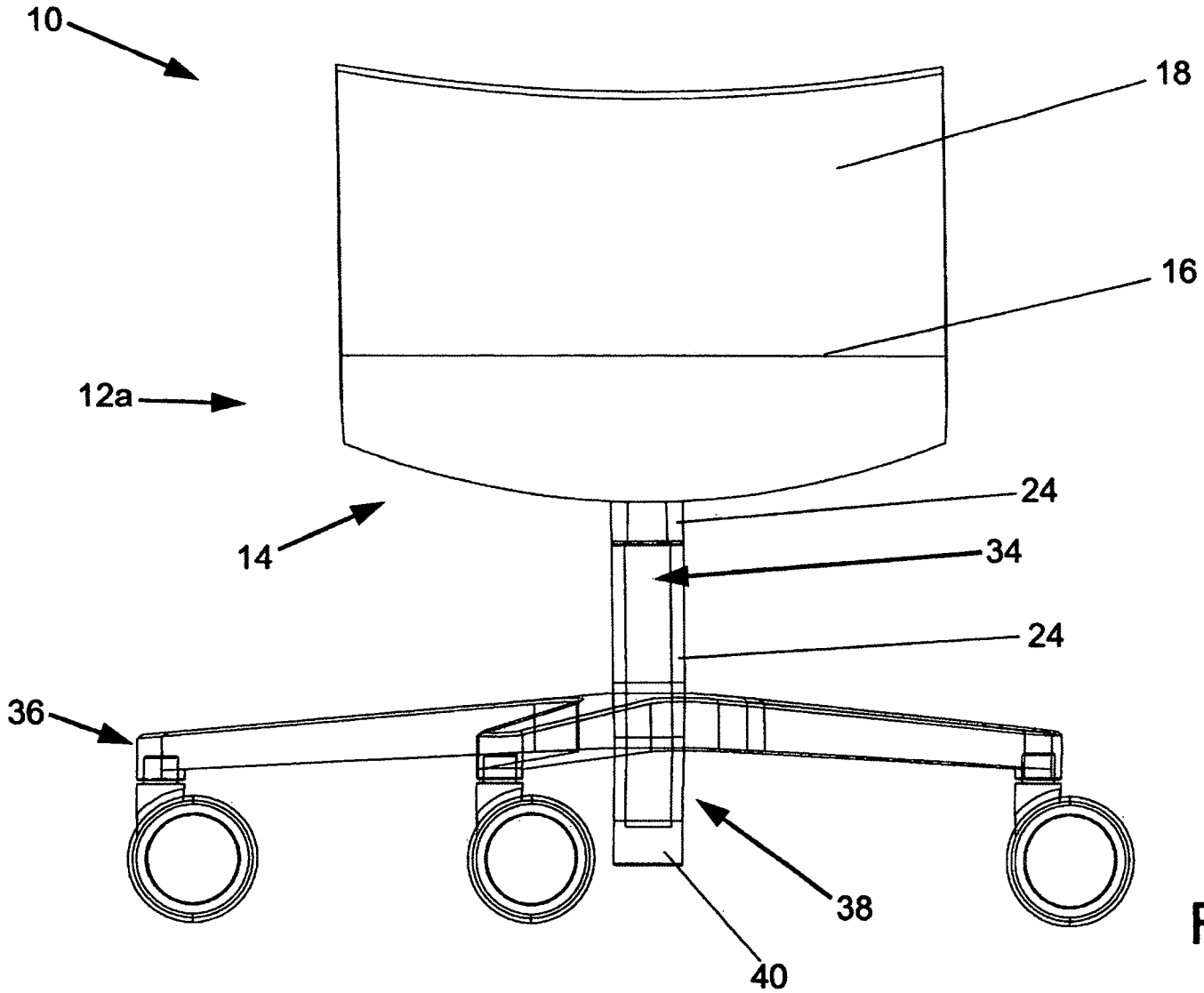
FIG. 3 shows a front view of the seating and support furniture from FIG. 1 in a first end position.

FIG. 3 shows the seating and support furniture 10 as a front view in the first end position 12*a*. In this first end position 12*a*, the end region 40 of the stopping mechanism 38 is retracted, so that the seating and support furniture 10 can be moved by the castor system 36.

Figure 4:
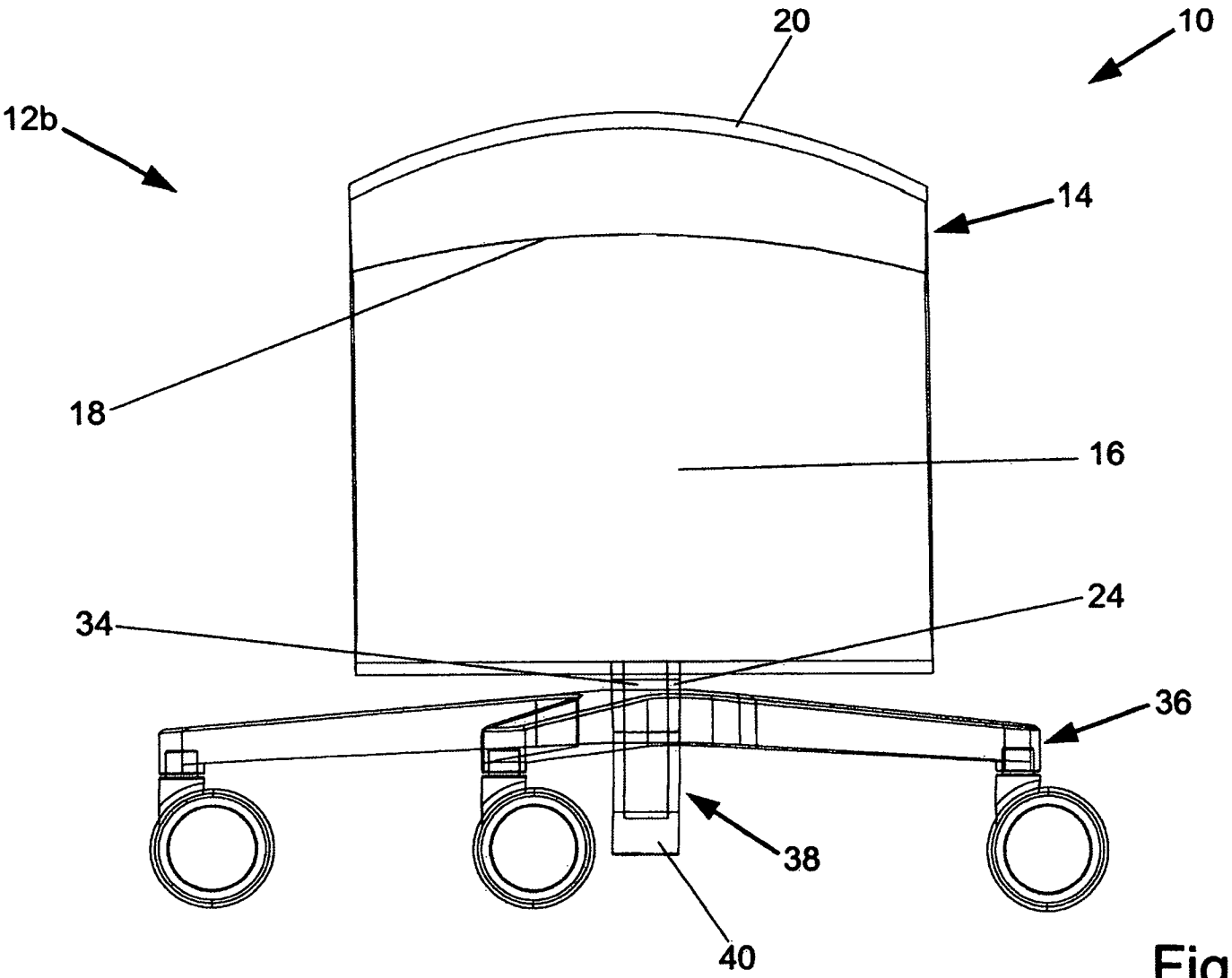
FIG. 4 shows a front view of the seating and support furniture from FIG. 1 in the second end position with the stopping mechanism not yet extended.

FIG. 4 shows the seating and support furniture 10 in front view in the second end position 12*b*, wherein the stand 24 is at the same height as in FIG. 3 and has not yet been moved by the spring system 34 into a lowered blocking position. In this state, the seating and support furniture 10 is not yet completely suitable for sit-sanding, as the support surface 20 is too low for an adult of normal height. In this state, the seating and support furniture 10 can still be moved along a floor by means of the castor system 36 to the preferred position in which the seating and support furniture 10 is to be used for sit-standing. FIG. 4 therefore shows that when the stand 24 is not yet height-adjusted, the end region 40 of the stopping mechanism 38 is furthermore retracted.

Figure 5:
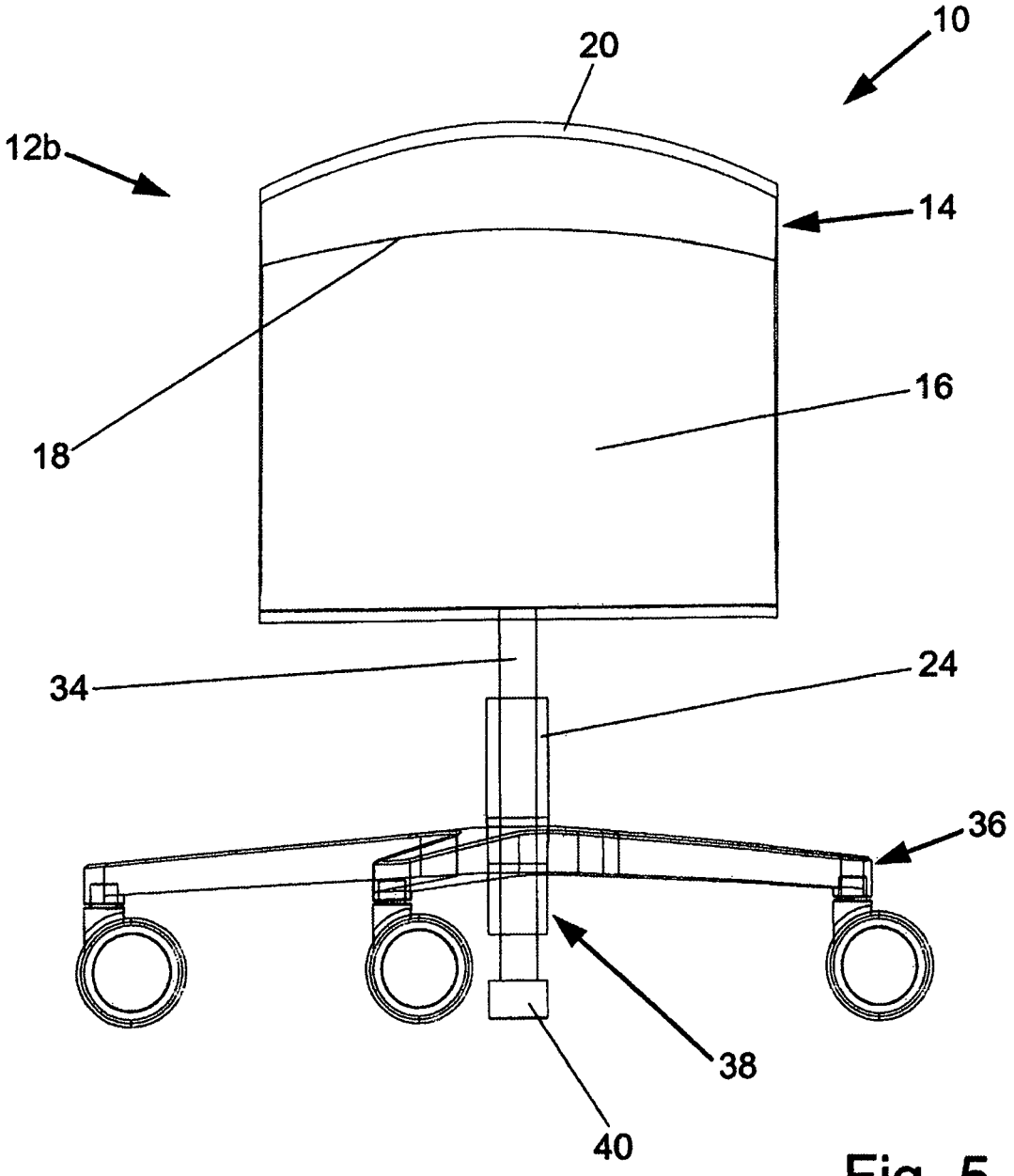
FIG. 5 shows the seating and support furniture from FIG. 1 in its second end position in front view with the stopping mechanism extended.

FIG. 5 shows the seating and support furniture 10 in turn as a front view in the second end position 12*b*, wherein by contrast with FIG. 4, the stand 24 has been height-adjusted by means of the spring system 34, so that a greater distance has been achieved between the castor system 36 and the support surface 20. The seating and support furniture 10 is located at such a height that the support surface 20 can be used by the user for sit-standing. In order to prevent the seating and support furniture 10 from accidentally moving, the end region 40 of the stopping mechanism 38 is extended, so that the contact of the end region 40 of the stopping mechanism 38 with a base or floor causes a braking effect to be initiated which blocks the movable castor system.

FIG. 1 shows that the seating and support corpus 14 comprises a cover part 42 which is arranged on a side of the seating and support corpus 14 facing away from the backrest 18. In this case, a surface of the cover part 42 forms the support surface 20. In FIG. 1, the cover part 42 is shown in its retracted position, so that an upper end of the cover part 42 does not extend beyond the remaining seating and support corpus 14.

Figure 6:
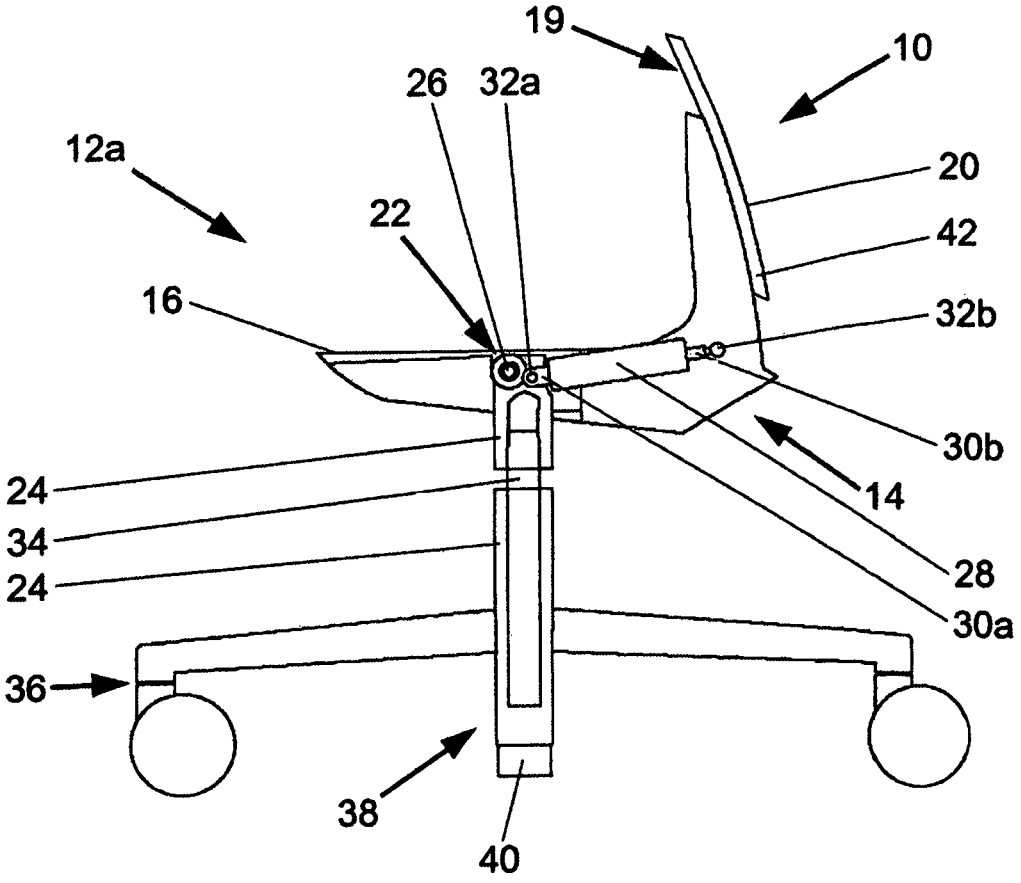
FIG. 6 shows the seating and support furniture from FIG. 1 in side view with a partially extended cover part.
Figure 7:
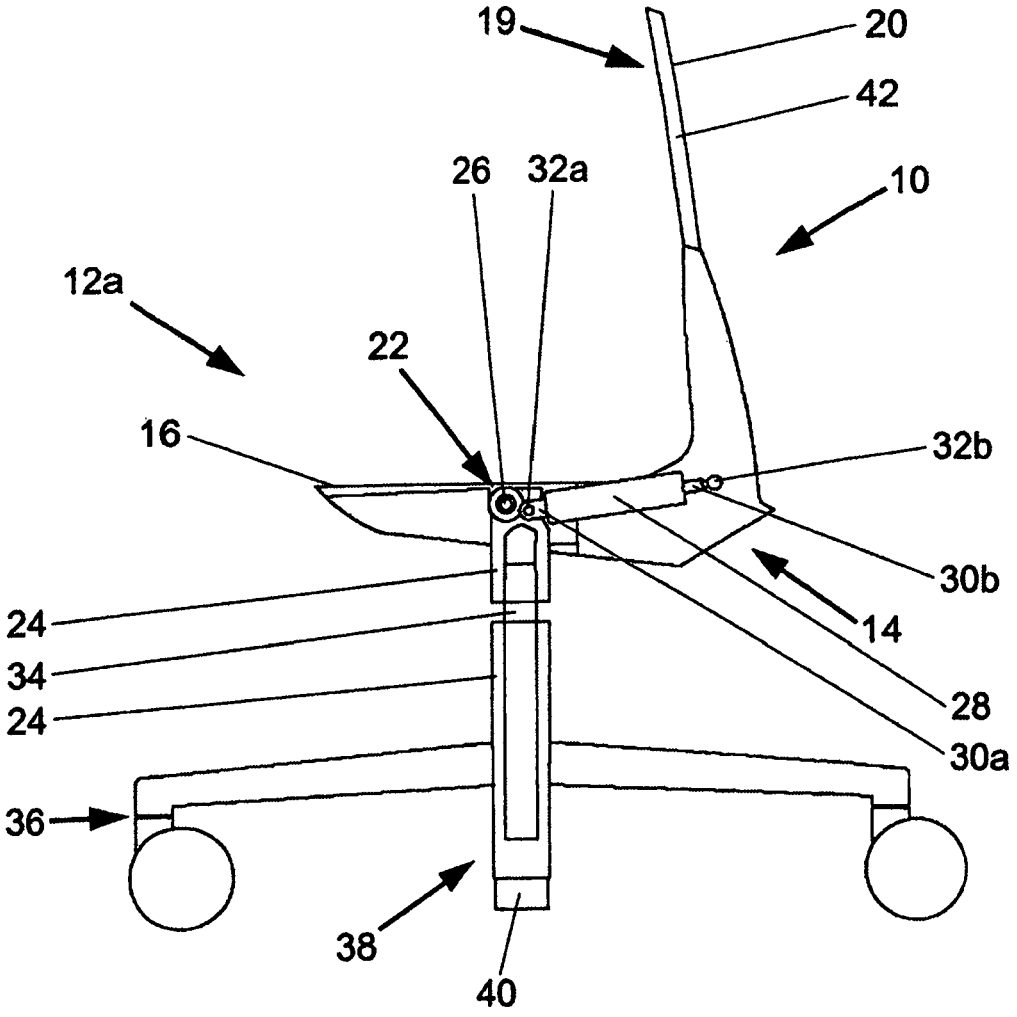
FIG. 7 shows the seating and support furniture from FIG. 1 in side view with the cover part completely extended.

FIG. 5 shows the cover part 42 in a partially extended position and FIG. 6 shows the cover part 42 in its completely extended position. The completely extended cover part 42 means that a lengthened backrest 19 is configured which is sectionally formed from the seating and support corpus 14 and from the cover part 42.

The cover part 42 may be attached to the seating and support corpus 14 via a sliding guide or guide kinematics, wherein the sliding guide or the guide kinematics is coupled to the pivoting movement of the seating and support corpus 14 in such a manner that the cover part 32 is extended or retracted according to the end position.

The invention works as follows: A user may use the seating and support furniture 10 in the first end position 12*a* shown in FIG. 1 for sitting. In this first end position, the user may extend the backrest 18 by means of the cover part 42 to the extended backrest 19. If the user would like to use the seating and support furniture 10 in the second end position 12*a* shown in FIG. 2 for sit-standing, he releases a lock which may be arranged on the spring 28, for example, so that the pivoting movement about the horizontal axis 26 is released. After the lock has been released, the spring 28 supports the pivoting movement into the second end position 12*b* or, if a correspondingly large spring force is chosen, the pivoting movement can be performed independently about the horizontal axis 26.

In the second end position, the seating and support furniture 10 is not yet at a suitable height for sit-standing. In this case, the spring system 34 exhibits such properties that it only triggers the stopping mechanism 38 from a predefined height through a vertical pressing force.

Initially, at the end of the pivoting movement in the end position 12*b*, the seating and support furniture 10 is not yet in a raised, height-adjusted position, so that a vertical force which is exerted on the support surface 20 would not yet lead to an extension of the end region of the stopping mechanism 40, as shown in FIG. 4.

Consequently, the spring system 34 adjusts the stand 24 to a desired height which corresponds to the height in FIG. 5, for example. This height exceeds the predefined height from which the spring system 34 can extend the stopping mechanism 38. If a vertical force is now exerted on the support surface 20, the end region 40 of the stopping mechanism 38 extends, as shown in FIG. 5, and thereby blocks the movable castor system, as a result of which the seating and support furniture 10 provides a secure hold for sit-standing. In this case, the spring system 24 provides both the height adjustment and also the property of extending the end region 40 of the stopping mechanism 38 from a certain height adjustment.

The user can lock the seating and support furniture 10 in the second end position 12*b*. By releasing this lock, the seating and support furniture 10 can pivot from the second end position 12*b* back again into the first end position 12*a*. In this case, the spring 28 damps the pivoting movement, i.e. the spring 28 is tensioned by manual pivoting. In a next step, the user releases the stopping mechanism 38, so that the seating and support furniture 10 can be moved again by means of the castor system 36 and adjusts the stand 24 to a desired seat height.

The invention claimed is:

1. A seating and support furniture, comprising a stand, and a seating and support corpus which is arranged on the stand such that it is pivotable about at least one horizontal axis, wherein the seating and support corpus has a seat surface which is arranged in a first end position of a pivoting movement about the horizontal axis in a substantially horizontal plane, wherein the seat surface in a second end position of the pivoting movement is arranged transversely to the horizontal plane, wherein the seating and support corpus has a support surface which is arranged on a side of the seating and support corpus spaced apart from the seat surface, wherein a movable castor system is attached to the stand, wherein the stand has an extendable stopping mechanism, wherein the extendable stopping mechanism can be activated from a predefined height, wherein a first end of a spring is attached to the stand, wherein a second end of the spring is attached to the seating and support corpus, wherein the spring supports a pivoting movement of the seating and support corpus about the horizontal axis, and wherein the stopping mechanism can be triggered by a vertical force on the seating and support corpus such that the castor system is prevented from moving.

2. The seating and support furniture as claimed in claim 1, wherein the stand is height-adjustable by a spring system.

3. The seating and support furniture as claimed in claim 2, wherein the spring system is housed in the stand.

4. The seating and support furniture as claimed in claim 1, further comprising an armrest.

5. The seating and support furniture as claimed in claim 1, wherein one side of the seating and support corpus opposite the support surface forms a backrest.

6. A seating and support furniture, comprising a stand, and a seating and support corpus which is arranged on the stand such that it is pivotable about at least one horizontal axis, wherein the seating and support corpus has a backrest, wherein the seating and support corpus has a seat surface which is arranged in a first end position of a pivoting movement about the horizontal axis in a substantially horizontal plane, wherein the seat surface in a second end position of the pivoting movement is arranged transversely to the horizontal plane, wherein the seating and support corpus has a support surface which is arranged on a side of the seating and support corpus spaced apart from the seat surface by the backrest, wherein a first end of a spring is attached to the stand, wherein a second end of the spring is attached to the seating and support corpus, and wherein the spring supports a pivoting movement of the seating and support corpus about the horizontal axis.

7. The seating and support furniture as claimed in claim 6, wherein the spring pretensions the seating and support corpus in a direction of the second end position of the pivoting movement.

8. The seating and support furniture as claimed in claim 6, wherein the pivoting can be triggered by a mechanism which releases a lock.

9. The seating and support furniture as claimed in claim 6, wherein the first end of the spring is pivotably attached to the stand, and wherein the second end of the spring is pivotably attached to the seating and support corpus.

10. The seating and support furniture as claimed in claim 6, wherein the horizontal axis and at least one articulation axis of the spring run parallel to one another.

11. The seating and support furniture as claimed in claim 6, wherein the first end of the spring is attached in a base plane below the horizontal axis, and wherein the second end of the spring is arranged in a moving-around plane above the horizontal axis.

12. The seating and support furniture as claimed in claim 6, wherein the seating and support corpus comprises a rigid load-bearing structure, and wherein the load-bearing structure reinforces and stiffens the seat surface and the support surface.

13. The seating and support furniture as claimed in claim 6, wherein the spring is lockable by a locking means, and wherein the locking means is releasable by an actuating button.

14. The seating and support furniture as claimed in claim 6, wherein the spring is housed in the seating and support corpus.

15. The seating and support furniture as claimed in claim 6, wherein the spring is configured as a gas spring.

16. The seating and support furniture as claimed in claim 6, wherein the stand is height-adjustable by a spring system which is housed in the stand.

17. A seating and support furniture, comprising a stand, and a seating and support corpus which is arranged on the stand such that it is pivotable about at least one horizontal axis, wherein a movable castor system is attached to the stand for allowing a displacement of the seating and support furniture, wherein the seating and support corpus has a seat surface which is arranged in a first end position of a pivoting movement about the horizontal axis in a substantially horizontal plane, wherein the seat surface in a second end position of the pivoting movement is arranged transversely to the horizontal plane, wherein the seating and support corpus has a support surface which is arranged on a side of the seating and support corpus spaced apart from the seat surface, wherein the stand has an extendable stopping mechanism, wherein the extendable stopping mechanism can be activated from a predefined height, wherein the stopping mechanism can be triggered by a vertical force on the seating and support corpus to prevent said displacement of the seating and support furniture by means of the castor system.

18. The seating and support furniture as claimed in claim 17, wherein a cover part is movably attached to the seating and support corpus, and wherein the cover part is movable in respect of the seating and support corpus, so that on one side of the seating and support corpus facing away from the support surface, an extended backrest is formed by the extended cover part, the surface of said backrest being sectionally formed from the seating and support corpus and from the cover part.

19. The seating and support furniture as claimed in claim 18, wherein a kinematics of the cover part is coupled to the pivoting movement.

20. The seating and support furniture as claimed in claim 17, wherein the seating and support corpus comprises a rigid load-bearing structure, and wherein the load-bearing structure reinforces and stiffens the seat surface and the support surface.

* * * * *